US009468068B2

(12) United States Patent
Liao

(10) Patent No.: US 9,468,068 B2
(45) Date of Patent: Oct. 11, 2016

(54) LIGHT EMITTING DEVICE

(71) Applicant: HON HAI PRECISION INDUSTRY CO., LTD., New Taipei (TW)

(72) Inventor: Kuang-Yao Liao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/847,741

(22) Filed: Sep. 8, 2015

(65) Prior Publication Data

US 2016/0205740 A1 Jul. 14, 2016

(30) Foreign Application Priority Data

Jan. 12, 2015 (TW) ..... 104100871 A

(51) Int. Cl.
*H05B 33/08* (2006.01)

(52) U.S. Cl.
CPC ..... *H05B 33/0851* (2013.01); *H05B 33/089* (2013.01); *H05B 33/0809* (2013.01)

(58) Field of Classification Search
CPC ..... H05B 33/0815; H05B 33/0845; H05B 33/0854; H05B 37/02; H05B 33/0851; H05B 33/089
See application file for complete search history.

(56) References Cited

U.S. PATENT DOCUMENTS

2008/0103714 A1* 5/2008 Aldrich ..... G01J 3/46 702/81
2014/0055041 A1* 2/2014 Ramer ..... H05B 37/0209 315/153
2014/0253562 A1* 9/2014 Yaras ..... G09G 3/342 345/501
2016/0073473 A1* 3/2016 Fang ..... H05B 33/0887 315/224

* cited by examiner

*Primary Examiner* — Jany Richardson
(74) *Attorney, Agent, or Firm* — Zhigang Ma

(57) ABSTRACT

A light emitting device includes at least one light emitting unit, a micro controller and a control module. The control module includes a storage unit configured to store a reference sheet between an intensity of the light emitting unit and a current value of the light emitting unit. A light emitting diode (LED) control unit is configured to receive a control signal from the micro controller. A digital-to-analogue conversion unit is configured to transform the current value and the on/off status to a simulation signal. A LED driver unit is configured to control the on/off status and the intensity of the light emitting unit based on the simulation signal. The control module further includes an input pin and an output pin, and the input pin is electrically connected with output pin in series when the multiple light emitting devices are provided.

13 Claims, 3 Drawing Sheets

LIGHT EMITTING DEVICE

FIELD

The subject matter herein generally relates to a light emitting device.

BACKGROUND

A white light emitting diode (LED) is usually provided as a flash for a camera module or a video recorder. An infrared LED is usually provided as a focusing component of a camera module or a video recorder. The white LED and the infrared LED are independently operated in an electronic device, so that both the white LED and the infrared LED are controlled by their own control units and driver units.

BRIEF DESCRIPTION OF THE DRAWINGS

Implementations of the present technology will now be described, by way of example only, with reference to the attached figures.

DETAILED DESCRIPTION

Figure 1:
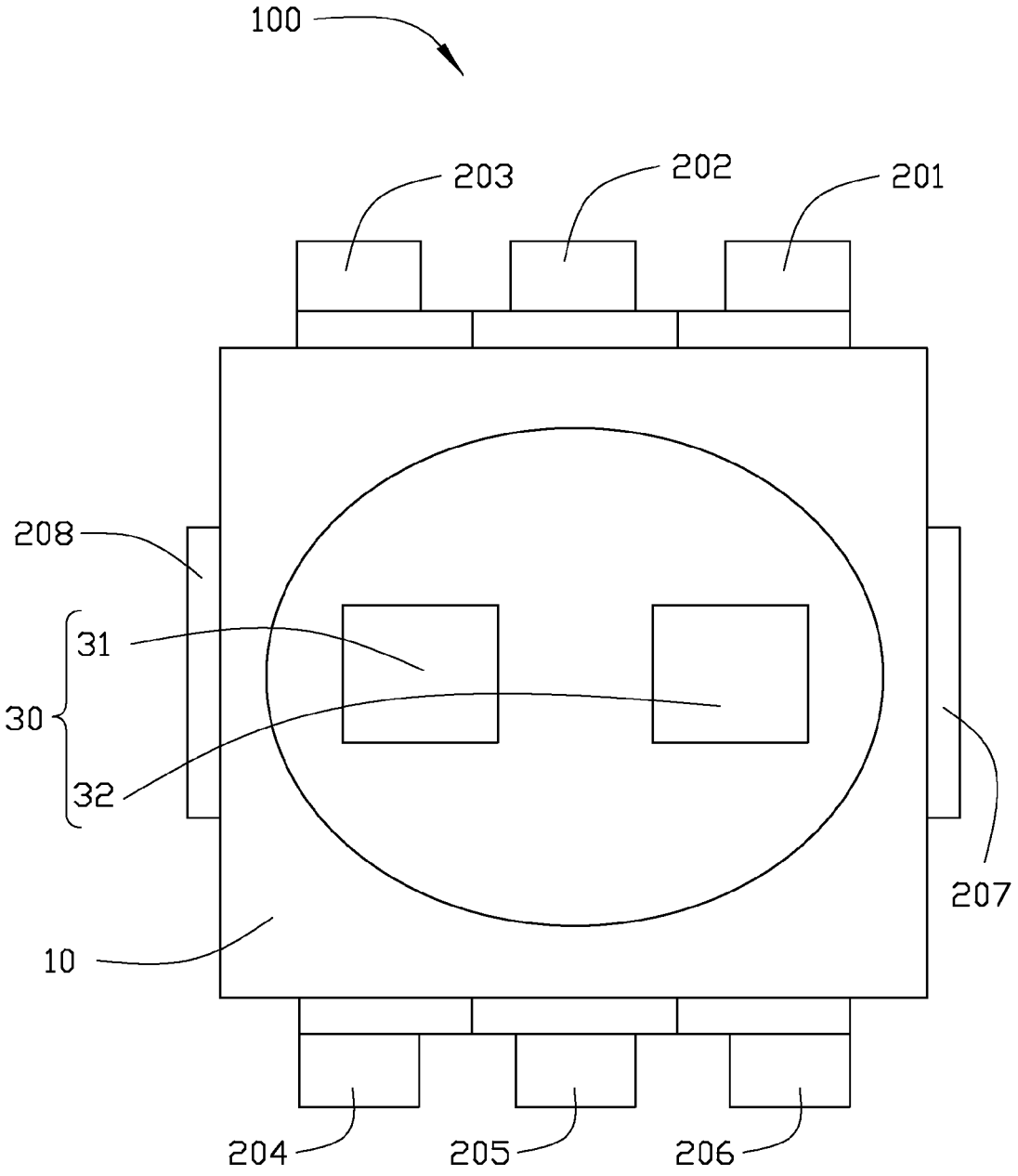
FIG. 1 is a diagrammatic view of a light emitting device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions substantially that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

The present disclosure is described in relation to a light emitting device.

FIG. 1 illustrates a light emitting device 100. The light emitting device 100 comprises a housing 10, a control module 20 (shown in FIG. 2), and a light emitting unit 30.

The housing 10 is a rectangular prism and substantially hollow. The control module 20 is received by the housing 10. The control module 20 is coupled to a micro controller 40. At least one light emitting unit 30 is electrically connected with the control module 20. At least one light emitting unit 30 is partially extended from the housing 10 so that the light emitting unit 30 can emit light. The control module is configured to receive control signals transmitted by the micro controller 40 to control the light emitting unit 30 to emit light with different intensity.

Figure 2:
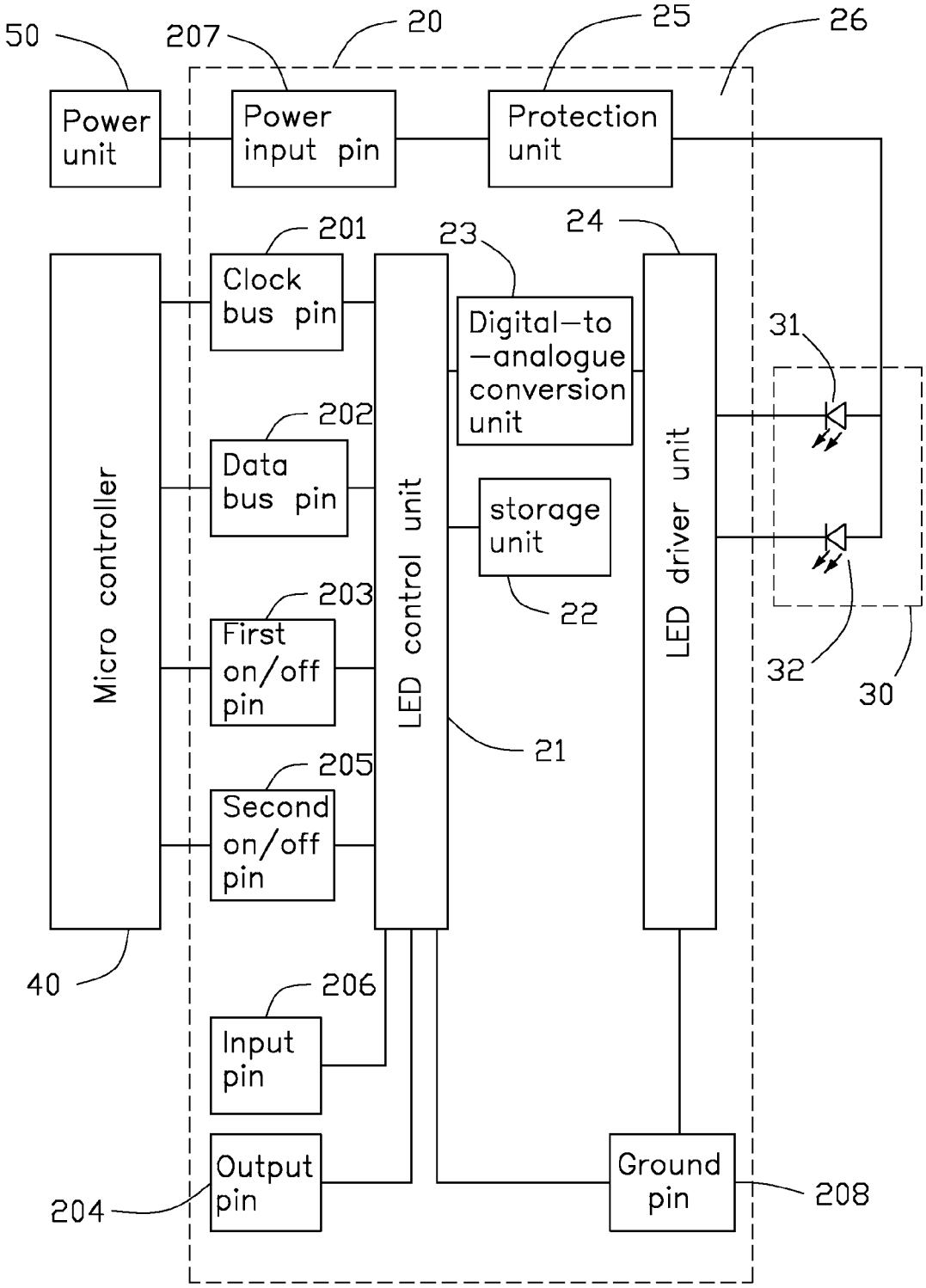
FIG. 2 is a block diagram of a control module coupled to a light emitting unit and a micro controller.

FIG. 2 illustrates a schematic block diagram of the control module 20. The control module 20 comprises a LED control unit 21, a storage unit 22, a digital-to-analogue conversion unit 23, a LED driver unit 24 and a protection unit 25.

The LED control unit 21, the storage unit 22, the digital-to-analogue conversion unit 23, the LED driver unit 24 and the protection unit 25 are integrated in a control chip 26.

The LED control unit 21 is electrically connected with the storage unit 22 and the digital-to-analogue conversion unit 23. The digital-to-analogue conversion unit 23 is electrically connected with the LED driver unit 24. The LED driver unit 24 has a ground terminal to connect with ground side. The LED driver unit 24 is electrically connected with the light emitting unit 30. The light emitting unit 30 is coupled to a power unit 50 through a protection unit 25.

The control module 20 has multiple pins which comprise at least one data bus pin, at least one input pin, at least one output pin, at least one power input pin, at least one ground pin and at least one on/off pin.

In at least one embodiment, the control module 20 has eight pins which include a clock bus pin 201, a data bus pin 202, a input pin 206, a output pin 204, a power input pin 207, a ground pin 208, a first on/off pin 203 and a second on/off pin 205.

In some embodiments, only one on/off pin or multiple pins can be provided. Every on/off pin is configured to control on/off status of a light emitting unit or a set of light emitting units.

In some embodiments, the on/off pin is a switch pin or is coupled to a switch mechanism. The switch pin or the switch mechanism is not limited to control the on/off status of a light emitting unit or a set of light emitting units but is configured to control on/off status of the different light emitting units or the set of light emitting units. For example, the switch mechanism could control a set of light emitting units to be half of light emitting units at "on" status and half of the set of light emitting units at "off" status.

In at least one embodiment, the clock bus pin 201, data bus pin 202, a first on/off pin 203 and a second on/off pin 205 are coupled to the micro controller 40 and the LED control unit 21. The output pin 204, the input pin 206 and the ground pin 208 are electrically connected with the LED control unit 21. The power input pin 207 is electrically connected with the power unit 50 and protection unit 25.

The micro controller 40 is configured to generate a control signal when a user controls and operates the light emitting device 100. The control signal comprises information related to the intensity of the light emitting unit 30 and the on/off status of the light emitting unit 30.

The information of the intensity of the light emitting unit 30 is transmitted through the clock bus pin 201 and the data bus pin 202 to the LED control unit 21. In this embodiment, the clock bus pin 201 is coupled to the micro controller 40 through a clock bus (not shown). The data bus pin is coupled to the micro controller 40 through a data bus (not shown). The information of the intensity of the light emitting unit 30 is transmitted through the clock bus and the data bus to the LED control unit 21.

The information of the on/off status is transmitted to the LED control unit 21 through the on/off pins. In at least one embodiment, the light emitting unit 30 comprises a first light emitting unit 31 and a second light emitting unit 32. The first light emitting unit 31 is a white LED. The second light emitting unit 32 is an infrared LED. The micro controller 40 is configured to transmit the information of the on/off status corresponding to the first light emitting unit 31 to the LED control unit 21 through the first on/off pin 203. The micro controller 40 is configured to transmit the information of the on/off status corresponding to the second light emitting unit 32 to the LED control unit 21 through the second on/off pin 205.

The storage unit 22 is configured to store data in a reference sheet between an intensity of the light and a current value. In at least one embodiment, the storage unit 22 is configured to store a reference sheet between the intensity of the first light emitting unit 31 and the current value of the first light emitting unit 31. The storage unit 22 is also configured to store another reference sheet between the intensity of the second light emitting unit 32 and the current value of the second light emitting unit 32. The reference sheet between the intensity of the light and the current value of the light is provided by the calibration information of the features of the first light emitting unit 31 and the calibration information of the features of the second light emitting unit 32. For example, when the first light emitting unit 31 receives a specific current, a corresponding intensity of light is generated by the first light emitting unit 31 by referring to the reference sheet.

When the LED control unit 21 receives a control signal, the control signal is able to control the storage unit 22 to provide a current value based on the reference sheet. The current value and the information of the on/off status are both transmitted to the digital-to-analogue conversion unit 23.

In at least one embodiment, the LED control unit 21 is configured to read a current value corresponding to the intensity of the first light emitting unit 31 from the storage unit 22 based on the reference sheet. The current value and the information of the on/off status corresponding to the first light emitting unit 31 are both transmitted to the digital-to-analogue conversion unit 23. The LED control unit 21 is also configured to read another current value corresponding to the intensity of the second light emitting unit 32 from the storage unit 22. The current value and the information of the on/off status corresponding to the second light emitting unit 32 are both transmitted to the digital-to-analogue conversion unit 23.

The digital-to-analogue conversion unit 23 is configured to transform the current values and the information of the on/off status to a simulation signal. The simulation signal is transmitted to the LED driver unit 24.

The LED driver unit 24 is configured to control the on/off status corresponding to the light emitting unit 30 and an intensity of the light emitting unit 30 based on a simulation signal.

In this embodiment, the LED driver unit 24 is configured to control the on/off status corresponding to the first light emitting unit 31 and the intensity of the first light emitting unit 31 based on a simulation signal. The LED driver unit 24 is also configured to control the on/off status corresponding to the second light emitting unit 32 and the intensity of the second light emitting unit 32 based on a simulation signal.

The protection unit 25 is coupled to the power unit 50 and the light emitting unit 30 for protecting the light emitting unit 30 when any current, voltage or temperature problems happen.

In some embodiments, if the current or voltage is stable when the light emitting unit 30 operates, the protection unit 25 is not provided.

The LED control unit 21, the storage unit 22, the digital-to-analogue conversion unit 23 and the LED driver unit 24 are all integrated on the light emitting device 100. According to the reference sheet, every light emitting unit is tuned to the best mode for requirements of the user.

In some embodiments, the information of the intensity of the light and the information of on/off status is transmitted to the LED control unit through at least one on/off pin.

Figure 3:
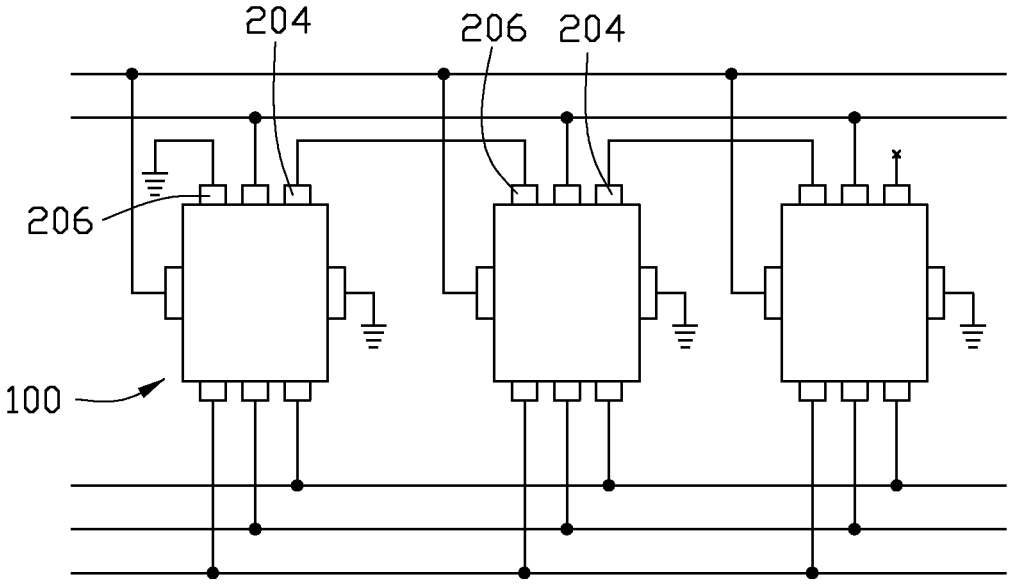
FIG. 3 illustrates a circuit diagram of one embodiment of connections for multiple light emitting devices.

FIG. 3 illustrates an embodiment of connections among multiple light emitting devices 100.

When the multiple light emitting devices 100 are being connected, the input pin 206 is electrically connected in series with output pin 204.

The embodiments shown and described above are only examples. Many details are often found in the art such as the other features of a light emitting device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A light emitting device comprising:

at least one light emitting unit;

a micro controller coupled to the at least one light emitting unit;

a control module coupled to the micro controller and comprising:

a storage unit configured to store a reference sheet between an intensity of the at least one light emitting unit and a current value of the light emitting unit;

a light emitting diode (LED) control unit configured to receive a control signal from the micro controller, the control signal comprises an information related to the intensity of the light emitting unit and an on/off status of the light emitting unit, wherein the control signal is configured to control the storage unit to provide a current value corresponding to the intensity of the at least one light emitting unit based on the reference sheet in the storage unit;

a digital-to-analogue conversion unit configured to transform the current value and the on/off status to a simulation signal, and a LED driver unit configured to control the on/off status and the intensity of the at least one light emitting unit based on the simulation signal.

2. The light emitting device of claim 1, wherein the control module further comprises a protection unit coupled to the power unit and the light emitting unit, and the protection unit is configured to protect the light emitting unit when any current, voltage or temperature problems happen.

3. The light emitting device of claim 1, wherein the control module further comprises a data bus pin coupled to the micro controller through a data bus, and the information of the intensity of the light emitting unit is transmitted through the data bus pin to the LED control unit.

4. The light emitting device of claim 3, wherein the control module further comprises a clock bus pin coupled to the micro controller through a clock bus, and the information of the intensity of the light emitting unit is transmitted through the clock bus pin and the data bus pin to the LED control unit.

5. The light emitting device of claim 1, wherein the control module further comprises at least one on/off pin, the on/off pin coupled to the micro controller, and the LED control unit is configured to control the light emitting unit through transmitting the information related to the on/off status of the light emitting unit to the LED control unit.

6. The light emitting device of claim 5, wherein the on/off pin is a switch pin, and the switch pin is configured to control on/off status of the light emitting units.

7. The light emitting device of claim 5, wherein the on/off pin is coupled to a switch mechanism, and the switch mechanism is configured to control on/off status of the light emitting units.

8. The light emitting device of claim 1, wherein the control module further comprises at least one on/off pin, and the on/off pin coupled to the micro controller and the LED control unit is configured to control the light emitting unit through transmitting the information related to the intensity of the light emitting unit and the on/off status of the light emitting unit to the LED control unit.

9. The light emitting device of claim 1, wherein the control module further comprises a power input pin and a ground pin, the power input pin is coupled to a power unit and the light emitting unit, the light emitting unit is coupled to a LED driver unit, and the LED driver unit is coupled to the ground pin and drives the light emitting unit.

10. The light emitting device of claim 1, wherein the control module further comprises an input pin and an output pin, and the input pin is electrically connected with output pin in series when the multiple light emitting devices are provided.

11. The light emitting device of claim 1, wherein at least one white LED unit and at least one infrared LED unit are provided, and the control module comprises a first on/off pin to control the on/off status of the white LED unit, and a second on/off pin to control the on/off status of the infrared LED unit.

12. The light emitting device of claim 1, wherein the lighting emitting device further comprises a control chip, and the storage unit, the digital-to-analogue conversion unit, the LED driver unit and the protection unit are integrated on the control chip.

13. A control module comprising:

a storage unit configured to store a reference sheet between an intensity of the at least one light emitting unit and a current value of the light emitting unit;

a light emitting diode (LED) control unit configured to receive a control signal from the micro controller, the control signal comprises an information related to the intensity of the light emitting unit and an on/off status of the light emitting unit, wherein the control signal is configured to control the storage unit to provide a current value corresponding to the intensity of the at least one light emitting unit based on the reference sheet in the storage unit;

a digital-to-analogue conversion unit configured to transform the current value and the on/off status to a simulation signal, and a LED driver unit configured to control the on/off status and the intensity of the at least one light emitting unit based on the simulation signal.

* * * * *